United States Patent [19]

Shute

[11] Patent Number: 4,765,614

[45] Date of Patent: Aug. 23, 1988

[54] EXERCISE MACHINE FOR PERSON CONFINED TO A WHEELCHAIR

[76] Inventor: Sammy Shute, 5721 Barkwood St., Jackson, Miss. 39211

[21] Appl. No.: 82,114

[22] Filed: Aug. 6, 1987

[51] Int. Cl.[4] ..... A63B 21/06; A63B 23/04

[52] U.S. Cl. ..... 272/130; 272/134

[58] Field of Search ..... 272/130, 134, 144, 900; 414/921; 188/2 F, 32

[56] References Cited

U.S. PATENT DOCUMENTS

| | | | |
|---|---|---|---|
| 2,661,817 | 12/1953 | Mullins | 188/32 |
| 4,153,244 | 5/1979 | Tauber, Jr. | 272/900 |
| 4,402,502 | 9/1983 | Peters | 272/143 |
| 4,645,205 | 2/1987 | Wolff | 272/130 |

*Primary Examiner*—Richard J. Apley
*Assistant Examiner*—Franklin L. Gubernick
*Attorney, Agent, or Firm*—Dewitt L. Fortenberry, Jr.

[57] ABSTRACT

A weight machine for use by persons confined to a wheelchair designed so that the person so confined may independently, or with minimal assistance, use the exercise machine. The frame of the exercise machine extends outwardly beyond the backrest and a plurality of ramp members are pivotally connected to said frame so that the person confined to a wheelchair can back onto the ramp members and each will pivot toward the machine thereby allowing the person confined to the wheelchair to back up to the machine until their back is against the backrest of the exercise machine. The backrest is positioned to provide support for the person's spine throughout the various exercises which may be performed. When the exercises are completed, the wheelchair can be rolled forward causing the ramp members to pivot away from the weight machine and allowing the person confined to the wheelchair to exit.

4 Claims, 2 Drawing Sheets

EXERCISE MACHINE FOR PERSON CONFINED TO A WHEELCHAIR

SUMMARY OF THE INVENTION

This invention relates to an exercise machine for persons confined to a wheelchair. More specifically, it consists of a weight machine having an extension which allows the wheelchair confined person to position himself to use the weight machine independently or with minimal assistance.

When reference is made to a person confined to a wheelchair, it is understood that confinement may be permanent or temporary but in either case, the person so confined generally has the complete or partial use of body muscles above the waist.

During the past decade numerous patents have issued in the area of exercise equipment and weight machines. However, there has been little development in the area of weight machines for persons confined to wheelchairs. Typically, for a person confined to a wheelchair to use a weight machine for exercise purposes, the assistance of another person is necessary. Examples of such weight machines are disclosed in U.S. Pat. No. 2,718,396; U.S. Pat. No. 2,735,422; U.S. Pat. No. 4,153,244; U.S. Pat. No. 4,402,502.

A need therefore exists for a weight machine adaptable so as to allow a person confined to a wheelchair to use the machine independently.

It is therefore an object of this invention to enable a person confined to a wheelchair to use a weight machine independently or with minimal assistance, depending upon the extent of a person's muscle use.

Another object of this invention is to provide a weight machine which is simple in design and relatively inexpensive.

It is also an object of this invention to provide a device capable of being adapted for use with various types of weight or user-manipulated, force-resisting exercise machines.

Yet another object of this invention is to provide an attachment to a weight machine which is positioned so that when a person confined to a wheelchair is using the weight machine, that person's spinal column has adequate support.

Further objects and advantages of this invention will become more apparent in light of the following description of the preferred embodiment.

DETAILED DESCRIPTION OF THE DRAWINGS

Figure 1:
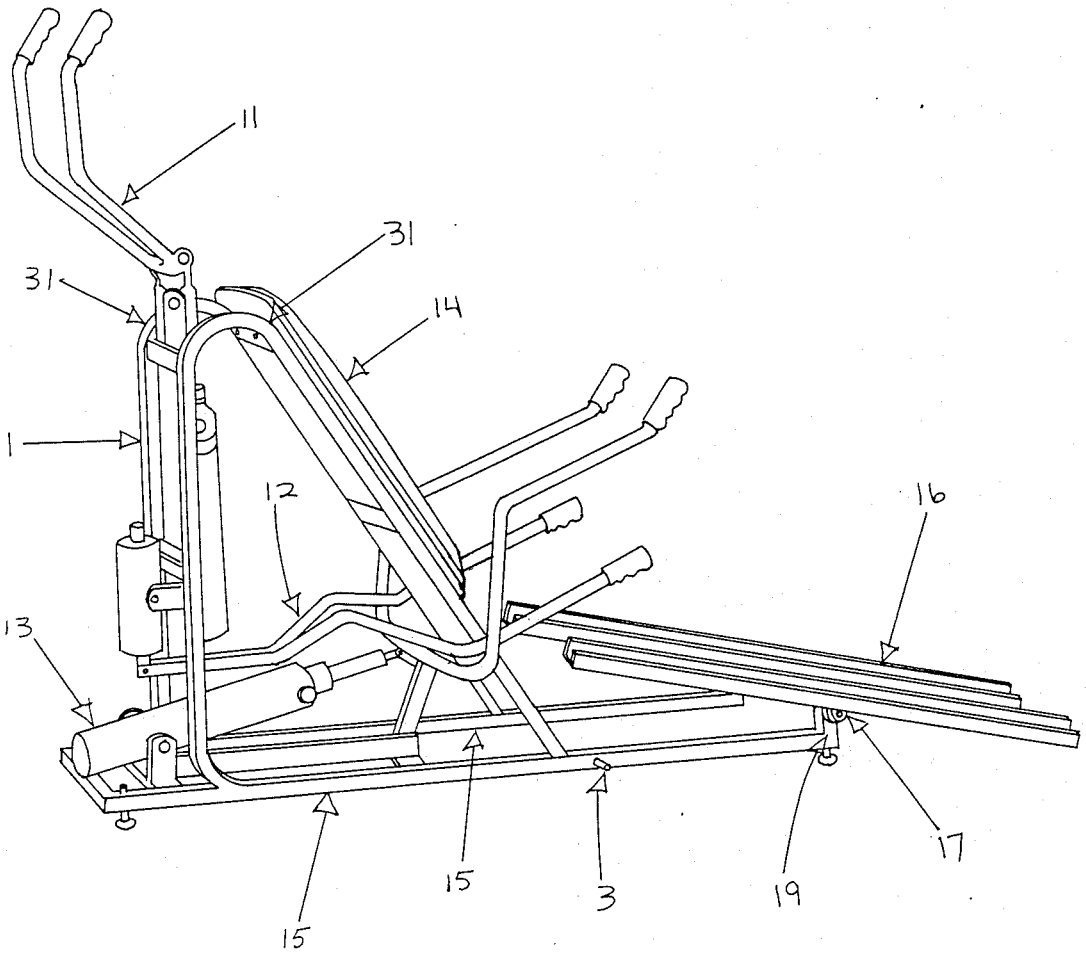
FIG. 1 is a side view of the invention.
Figure 2:
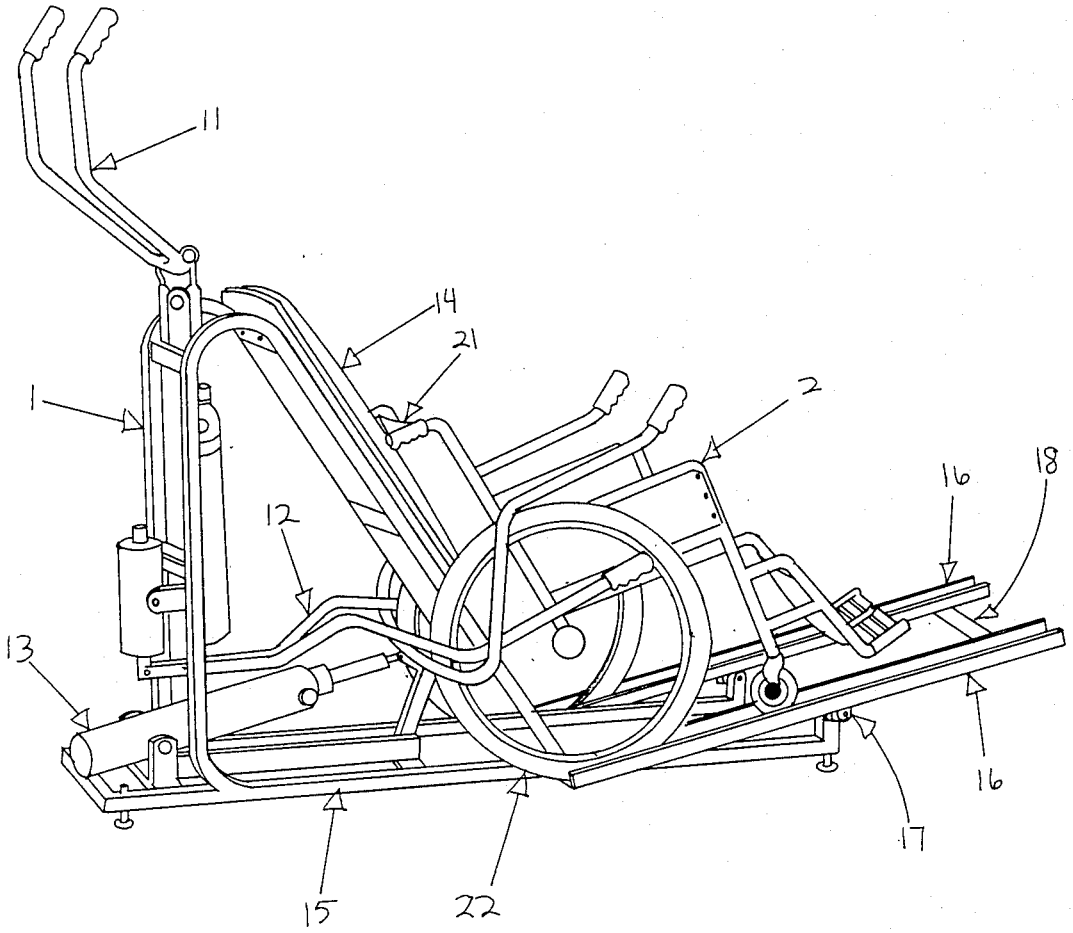
FIG. 2 is a view of the invention and its relationship to a wheelchair as if a person were using the weight machine.

Referring now to FIG. 1, the invention consists of an exercise machine 1 having any assortment of pneumatically controlled resistance members 11, 12, and 13. It is noted that for the purpose of this invention the pneumatically controlled resistance members may be replaced with various pieces of apparatus such as bars, weights, torque-type devices, and other similar equipment enabling a person to complete any exercise desired. Said exercise machine 1 also consists of a frame 31 having a plurality of base frame members 15. Said plurality of base frame members 15 extend outwardly beyond a backrest 14 which is supported by said frame 31. Each of said base frame members 15 have an upwardly extending arm 19 having a pivot bar 17 extending outwardly and perpendicularly therefrom. A ramp member 16 is pivotally connected to each pivot bar 17. The ramp members 16 are also interconnected by a interconnecting bar 18 as shown in FIG. 2. In the preferred embodiment, said ramp members 16 are channel shaped.

Each base frame member 15 also has a rubber-like shock absorber 3 extending outwardly and positioned so that said ramp member 16 will rest on said shock absorbers 3 when the ramp members 16 are in the position shown in FIG. 2.

Referring now to FIG. 2, when a person confined to a wheelchair desires to use the weight machine, a wheelchair is easily backed onto the ramp members 16 until the weight of the wheelchair 2 and its occupant cause the ramp members 16 to pivot toward the exercise machine 1 thereby allowing the person confined to the wheelchair 2 to roll backwards in the direction of the exercise machine 1 until that person's back is supported by backrest 14 of the exercise machine 1. It is important to note that in this position the backrest 14 provides support for the spinal column of the person confined to the wheelchair thereby allowing that person to use the assortment of pneumatically controlled resistance members 11, 12, and 13 of the exercise machine 1.

Upon completion of an exercise workout, the person confined to the wheelchair can roll the chair forward until his weight and the weight of the chair cause ramp members 16 to pivot away from the exercise machine 1 thereby allowing the person to exit the machine.

It should be noted that although not mentioned, the material and manner of fabrication of the invention may be varied without departing from the scope and intent of this invention. Additionally, although the specific details of one embodiment of this invention has been shown and described herein, the invention is not confined thereto since changes and alterations may be made without departing from the spirit and scope thereof as defined in the claims.

I claim:

1. An exercise machine for persons confined to a wheelchair, comprising:

a frame having a back rest and a plurality of base members extending outwardly beyond said back rest, said base members each having an upwardly extending arm having a pivot bar attached thereto;

a plurality of ramp members for accepting the wheels of a wheelchair, said ramp members pivotly secured to said pivot bar;

a multiplicity of resistance members secured to said frame;

whereby the ramp members can be pivoted away from the back rest so that a person confined to a wheelchair can back the wheels of the wheelchair onto the ramp members until the weight of the wheelchair and the person confined to the wheelchair causes the ramp members to pivot toward the back rest allowing the wheelchair to roll in the direction of the weight machine until the back of the person confined to the wheelchair comes in contact with the back rest so that the person confined to the wheelchair can use the multiplicity of resistance members for exercising and after exercising, the wheelchair can be rolled away from the back rest causing the ramp members to pivot away from the exercise machine so that the person confined to the wheelchair may exit.

2. The exercise machine recited in claim 1 wherein said ramp members are channel shaped.

3. The exercise machine recited in claim 2 wherein an interconnecting bar connects said ramp members.

4. The exercise machine recited in claim 3 wherein each base member has a shock absorber whereby when said ramp members are pivoted toward the back rest, said ramp members will rest on the shock absorber thereby cushioning the impact of the ramp members when said ramp members are pivoted as the result of the weight of the wheelchair and the person confined to the wheelchair.

* * * * *